United States Patent [19]

Moser

[11] Patent Number: 4,930,649

[45] Date of Patent: Jun. 5, 1990

[54] REFUSE CONTAINER WITH MOLDED HINGE

[75] Inventor: John B. Moser, Seattle, Wash.

[73] Assignee: North American Roto-Molding Corp., Vancouver, Wash.

[21] Appl. No.: 395,545

[22] Filed: Aug. 18, 1989

[51] Int. Cl.[5] ..... B65D 43/14

[52] U.S. Cl. ..... 220/1 T; 220/338; 220/341; 220/94 A

[58] Field of Search ..... 220/337, 338, 341, 1 T, 220/94 A

[56] References Cited

U.S. PATENT DOCUMENTS

| | | | |
|---|---|---|---|
| 3,497,908 | 3/1970 | Zamarra | 220/338 |
| 4,109,821 | 8/1978 | Lutz | 220/338 |
| 4,216,862 | 8/1980 | Daenen | 220/337 |
| 4,349,121 | 9/1982 | Lafferty | 220/341 |
| 4,401,312 | 8/1983 | Parker . | |
| 4,450,976 | 5/1984 | Snyder et al. . | |
| 4,558,799 | 12/1985 | Hammond . | |
| 4,663,803 | 5/1987 | Gora . | |
| 4,749,101 | 6/1988 | Durkan, Jr. . | |

*Primary Examiner*—Joseph Man-Fu Moy
*Attorney, Agent, or Firm*—Robert L. Harrington

[57] ABSTRACT

A rotationally molded container having hinge components integrally molded with the body and lid suited for the automated collection of refuse. The hinge sections molded with the lid have frusto-conical projections that mate with frusto-conical sockets in the hinge brackets molded with the body. Additionally, frusto-conical projections of the lid hinge sections seat in formed recesses of the handle molded on the body providing added strength and rigidity to the hinge.

4 Claims, 2 Drawing Sheets

REFUSE CONTAINER WITH MOLDED HINGE

BACKGROUND OF THE INVENTION

1. Field of the Invention

This invention relates to molded containers and in particular it relates to molded refuse containers having a lid pivotally attached to the body in a hinged arrangement by inter-connecting hinge components that are integrally molded with the body and lid.

2. Background Information

The collection of refuse from residential and commercial sites is becoming more and more automated. Increasing labor costs is one of the factors bringing about the change.

Semi-automatic and automatic equipment has been developed to collect the refuse that has been deposited in containers at residential and commercial sites. The equipment is installed on refuse trucks designed to collect and compact the refuse. The equipment elevates the container from ground level to the refuse receiving section of the truck, inverts the container to dump the refuse and returns the container to the ground level. The semi-automatic equipment requires positioning of the container by a laborer to the elevating mechanism. The automatic equipment has grappling arms or clamps that extend to grasp, elevate, and invert and then return the container to the ground without any handling by an individual.

The mechanized handling equipment required a standardization in container size and shape but it permitted the use of larger containers. Due to the increased size of the container, transport wheels and a suitable handle were provided so a user could easily move the container to curbside. Also since the containers were handled mechanically, a lid that was hinged to the body of the container was provided.

The mechanical handling of the containers subject them to high impact loads. The item most vulnerable to the impact loads is the hinge that secures the lid to the body of the container. It is therefore important to provide a hinge that has sufficient strength, not subject to undue wear, and also is easily assembled.

Providing a strong durable hinge has been a problem of the past containers on the market. Some of the hinges were fabricated and assembled to the container and lid after molding. This required additional parts, some alteration to the container which created stress points, and assembly of the parts to the container. The additional parts, the alterations required, the assembly and labor increased the cost of the container.

Typical of hinge arrangements that require additional parts for assembly are shown in U.S. Pat. Nos. 4,663,803 Gora, Security Hinge Joint With Separate Hinge Pin; 4,401,312 Parker, Automated Trash Receptacle; 4,450,976 Snyder et al, Wheeled Molded Container With Hinged Lid and 4,558,779 Hammond, Container with Hinged Lid.

Hinges that were molded to the lid and the container during the molding process have up to this point lacked in durability and strength. Projecting lobes were molded into the handle portion of the container. Mating recesses in the lid were mated to the lobes and assembly was accomplished by flexing the lid enough to permit the lobes to enter the recesses. The area of support generally was not large enough to stand the abuse the hinge would encounter during the many repetitive dumpings of the container.

U.S. Pat. No. 4,749,101 Durkan, Jr., Hinge Assembly For Lidded Refuse Containers shows a lid pivoted on the ends of pins extending from the handle. The pins that provide the total support for the lid are located at the end of the handle and are completely encased by the lid when attached to the container where stresses from overflexing the lid onto the container subjects the lid to failure.

SUMMARY OF THE INVENTION

The object of the present invention is to provide a hinge that is integrally molded to the body and to the lid of the container that does not require any additional parts to assemble.

It is also an object of the present invention to provide a hinge that has a large contact area supporting the bearing portion of the hinge.

The present invention not only supports the hinge by projections fitting in sockets but also has additional support structure in the molded handle of the container.

Other objects and advantages of the invention will be apparent from the drawings and the detailed description.

DESCRIPTION OF THE PREFERRED EMBODIMENT

Figure 1:
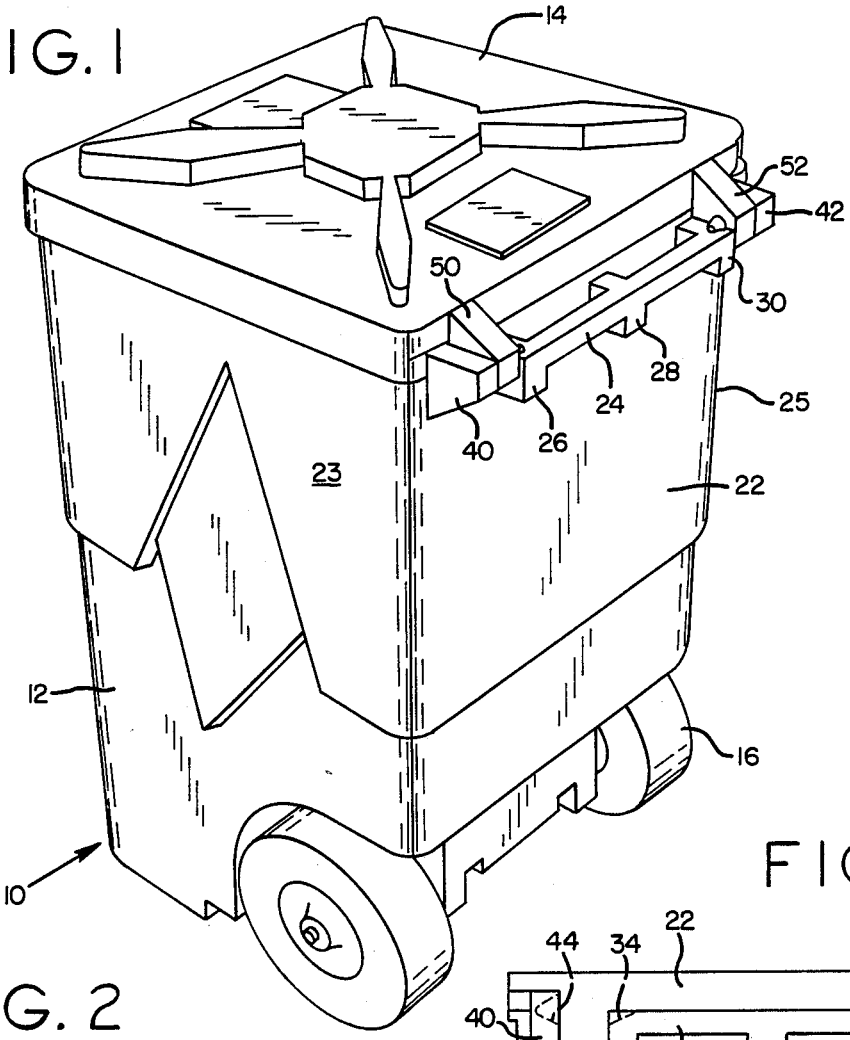
FIG. 1 is a view of a container with a hinged lid, handle and transport wheels.

Referring to FIG. 1, a container 10 suitable for refuse collection has a body 12, a hinged lid 14, and transport wheels 16. A handle 24 is provided on the body 12 to aid in tilting and transporting the container 10 on the wheels 16.

The container 10 is preferably rotationally molded of a high strength plastic material. The body 12 and the lid 14 of the container 10 are molded as a single unit. After removal from the mold, the body 12 and the lid 14 are parted from each other and trimmed. The lid 14 is pivotally attached to the body 12 by the inter-connection of the integrally molded hinge components of the body 12 and of the lid 14. The wheel assembly 16 is then installed on the body 12.

Figure 2:
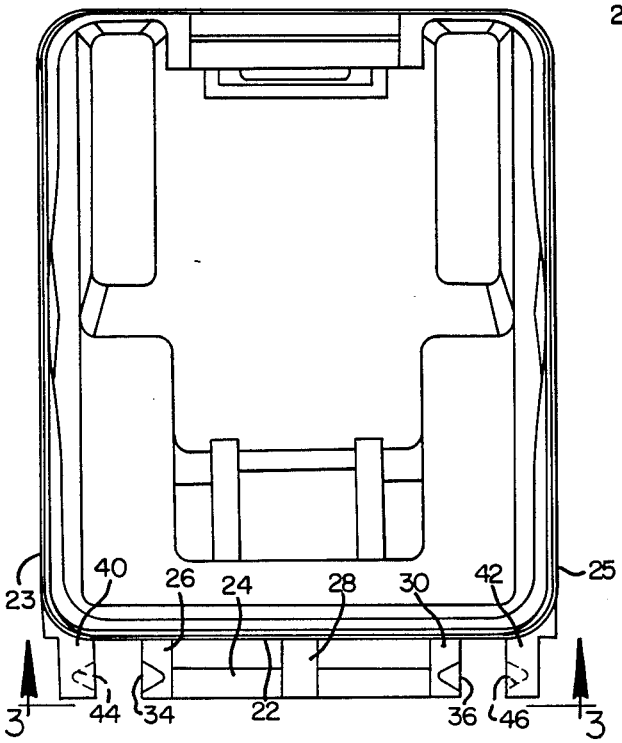
FIG. 2 is a top view of the body of the container of FIG. 1 showing details of the handle and hinge brackets.
Figure 3:
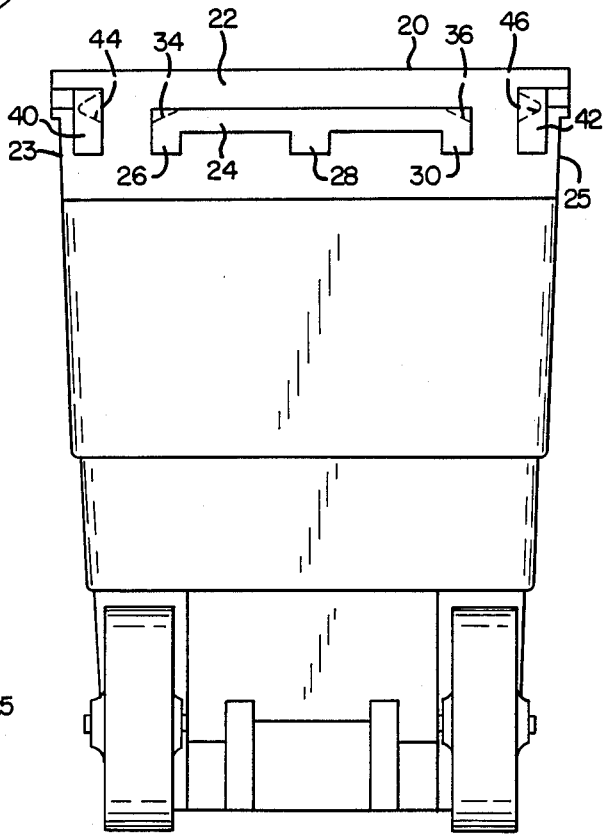
FIG. 3 is a partial side view as taken on view line 3—3 of FIG. 2.
Figure 6:
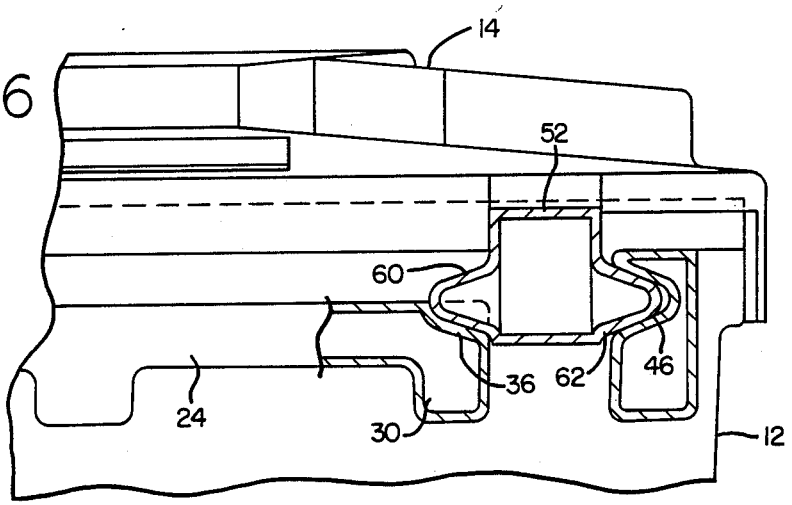

As shown in FIGS. 2 and 3, the body 12 of container 10 is basically rectangular in cross section. It has a bottom with two side walls 23, 25 and two end walls 21, 22 extending upwardly from the edges of the bottom with a slight tapering outward to form a cavity of the container 10. The side walls 23, 25 and end walls 21, 22 end at a common plane and form a top edge 20 of the body 12. The bottom portion of the container 10 is configured to accept the wheel assembly 16.

Integrally molded with body 12 near and parallel to the top edge 20 of end wall 22 is a handle 24 and support legs 26, 28, and 30. The handle 24 is centered relative to the end wall 22. The legs 26, 28, and 30 provide supporting distal connections between the handle 24 and the end wall 22. Leg 26 connects one end of the handle 24 to the end wall 22 and leg 30 connects the other end of handle 24 to the end wall 22. Leg 28 connects the center portion of the handle 24 to the end wall 22. The legs thus position the handle 24 at a distance from the end wall 22. The space between the legs 26 and 28 and the space between legs 28 and 30 provide hand holds permitting a user to grasp the handle 24 to tilt and transport the container 10 on the wheels 16. A formed recess 34 is provided in the handle 24 at leg end 26 and a formed recess 36 is provided in the handle 24 at leg end 30. The formed recesses 34 and 36 are semi-frusto-conical in shape and provide supportive bearing surfaces for the projections 58 and 60 of hinge sections 50 and 52.

Hinge brackets 40 and 42 molded with the body 12 are as shown in FIGS. 2 and 3. They are spaced from and positioned relative to the handle 24 on end wall 22. The bracket 40 is spaced from leg end 26 of handle 24 and is positioned near the side wall 23. The bracket 42 is spaced from leg end 30 of handle 24 and is positioned near the side wall 25. The hinge bracket 40 has a frusto-conical socket 44 and the hinge bracket 42 has a frusto-conical socket 46. The lower portion of socket 44 is aligned with the recess 34 in the handle 24. The lower portion of socket 46 is aligned with recess 36 in the handle 24.

Figure 4:
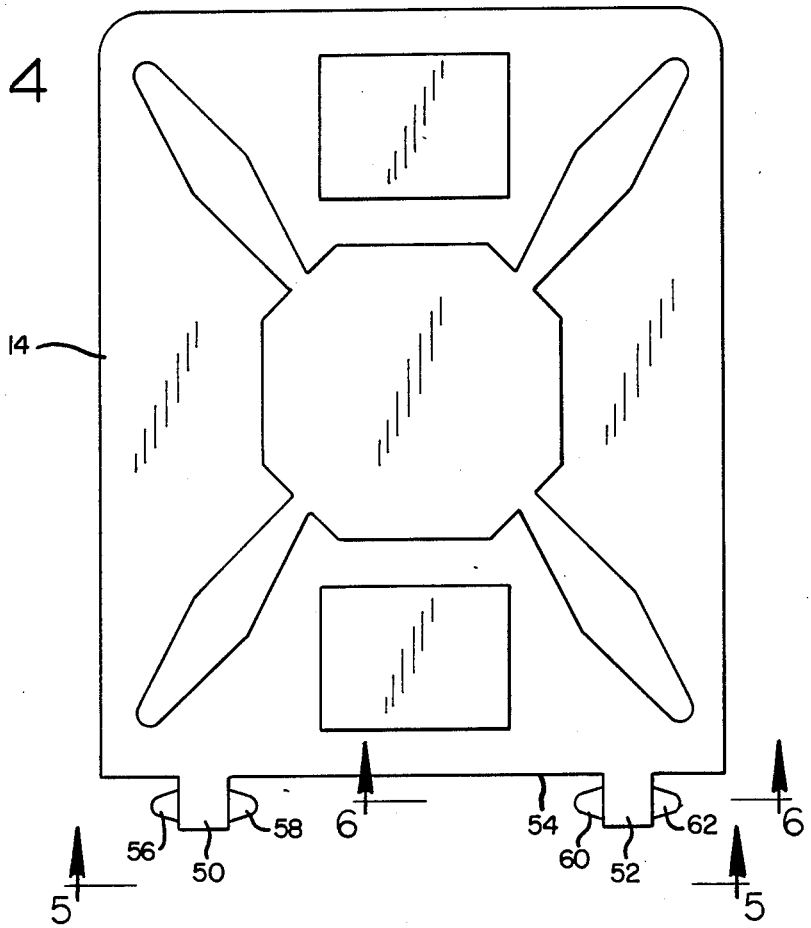
FIG. 4 is a top view of the lid showing details of the hinge sections that mate with the handle and hinge brackets of FIG. 2.
Figure 5:
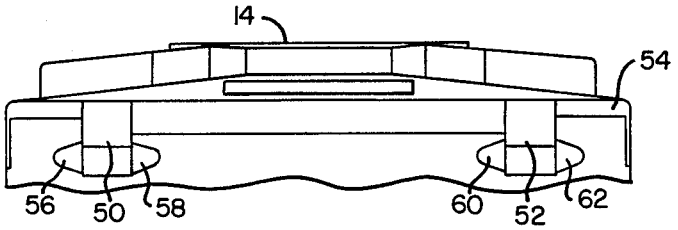
FIG. 5 is a partial side view as taken on view line 5—5 of FIG. 4.

FIGS. 4 and 5 show the hinge sections 50 and 52 that are integrally molded with the lid 14. The hinge sections 50 and 52 project outwardly and downwardly from the edge 54 of the lid 14. Extending from each side of the hinge sections 50 and 52 are frusto-conical projections. Hinge section 50 has projections 56 and 58. Hinge section 52 has projections 60 and 62. The hinge sections 50 and 52 are positioned and aligned on the edge 54 of the lid 14 in reference to the position of the handle 24 and of the hinge brackets 40 and 42 on the end wall 22 of the body 12. When the lid 14 is pivotally attached to the body 12, the hinge projections 58 and 60 will nest in the recesses 34 and 36 of the handle 24 and the projections 56 and 62 will seat in the sockets 44 and 46 of the brackets 40 and 42.

The lid 14 is pivotally attached to the body 12 by the interengagement of the the projections 56 and 62 (on the hinge sections 50 and 52 of the lid 14) with the sockets 44 and 46 (in the hinge brackets 40 and 42 of the body 12).

To pivotally attach the lid 14 to the body 12, the projection 62 of hinge section 52 is inserted into the socket 46. The lid 14 is flexed to reduce the distance between the end of projection 62 and the end of projection 56 permitting the insertion of projection 56 into the socket 44. The lid being resilient returns to its original shape causing the projections 56 and 62 to seat fully in the sockets 44 and 46.

The projection 56 fits rotatably within the socket 44 of bracket 40. The projection 62 fits rotatably within the socket 46 of the bracket 42. The projection 58 nests in bearing contact with the recess 34 of the handle 24. The projection 60 nests in bearing contact with the recess 36 of the handle 24.

The interconnection of the hinge components of the lid with the hinge components of the body provide a rigid, strong pivotal hinge arrangement. The projections 56 and 62 on the hinge sections 50 and 52 fitting within the sockets 44 and 46 of the hinge bracket 40 and 42 provide an axis of pivot. The large contact area between the projections 56,62 and the sockets 44,46 provide a sound structural connection by themselves. The additional support afforded by the projections 58 and 60 on the hinge sections 50 and 52 nesting in bearing contact with the recesses 34 and 36 of the handle 24 not only add to the strength of the hinge joint but also prevent any flexure or twisting of the hinge sections 50 and 52. This is accomplished by the recesses 34 and 36 supporting the projections 58 and 60 on the hinge sections 50 and 52 in three basic directions; from below and from each side. The support provided to the projections 58 and 60 by the recesses 34 and 36 keeps the projections 56 and 62 axially aligned within the sockets 44 and 46.

A preferred embodiment of a container with a pivotal hinge arrangement has been detailed. It is recognized that modifications and variations may be made without departing from the scope of the invention. The invention is not to be limited to the embodiment disclosed, but is to be determined according to the appended claims.

What is claimed is:

1. A portable molded refuse container having a lid pivotally attached to the body in a hinged arrangement comprising, a molded body having side walls, end walls and a bottom, a first hinge means and a handle means both integrally molded to an end wall of said body, said first hinge means including a pair of brackets projecting from the end wall with a bracket laterally spaced from each end of the handle means;

and a molded lid, said lid having a second hinge means integrally molded with said lid, said second hinge means including a pair of hinge sections projected from the lid and into the spacings between the brackets and handle means of the body, and connecting means pivotally connecting the hinge sections of the second hinge means to the brackets of the first hinge means, and said hinge sections and handle means being cooperatively configured whereby the lid is supported in part on said handle means.

2. A portable molded refuse container as defined in claim 1 wherein the connecting means is comprised of;

each of said brackets having a socket formed therein opening toward the spacing with the handle means, and said handle means having formed recesses paired with said sockets, each of said hinge sections having oppositely directed projections extending therefrom, one of said projections on the first of said hinge sections fitting rotatably within the socket formed in the first of said brackets, and one of said projections on the second of said hinge sections fitting rotatably within the socket formed in the second of said brackets, and a second of said projections on the first of said hinge sections seated in one of the formed recesses on said handle means and a second of said projections on the second of said hinge sections seated in another of the formed recesses on said handle means, and said projections fitting in the said sockets pivotally attaching said lid to said body in a hinged arrangement and said projections seated in said recesses providing a bearing support to said hinge sections.

3. A portable molded refuse container as defined in claim 2 wherein;

said sockets formed in said brackets are frusto-conical, and said recesses of said handle means are semi-frusto-conical, and said projections on said sections are frusto-conical.

4. A portable molded refuse container as defined in claim 3 including transport wheels attached to a lower portion of the body, and wherein;

the handle means includes an elongate handle integrally molded with said body and said handle centrally positioned parallel to and near an upper edge of an end wall on said body, and a plurality of spaced legs interconnecting said handle to said body to provide a spacing between the handle and body for hand holds to facilitate the tilting of the container on its transport wheels for ease of transport.

* * * * *